US011404758B2

(12) United States Patent
Giordano

(10) Patent No.: US 11,404,758 B2
(45) Date of Patent: Aug. 2, 2022

(54) IN LINE E-PROBE WAVEGUIDE TRANSITION

(71) Applicant: WHIRLPOOL CORPORATION, Benton Harbor, MI (US)

(72) Inventor: Francesco Giordano, Cremona (IT)

(73) Assignee: Whirlpool Corporation, Benton Harbor, MI (US)

( * ) Notice: Subject to any disclaimer, the term of this patent is extended or adjusted under 35 U.S.C. 154(b) by 554 days.

(21) Appl. No.: 15/970,925

(22) Filed: May 4, 2018

(65) Prior Publication Data

US 2019/0341667 A1 Nov. 7, 2019

(51) Int. Cl.

| | |
|---|---|
| ***H01P 5/02*** | (2006.01) |
| ***H01P 1/04*** | (2006.01) |
| ***H01P 3/12*** | (2006.01) |
| ***H05B 6/68*** | (2006.01) |
| ***H05B 6/70*** | (2006.01) |
| ***H05B 6/72*** | (2006.01) |

(52) U.S. Cl.

CPC ..... *H01P 5/024* (2013.01); *H01P 1/042* (2013.01); *H01P 3/12* (2013.01); *H05B 6/687* (2013.01); *H05B 6/705* (2013.01); *H05B 6/707* (2013.01); *H05B 6/72* (2013.01)

(58) Field of Classification Search

None

See application file for complete search history.

(56) References Cited

U.S. PATENT DOCUMENTS

| | | | | |
|---|---|---|---|---|
| 2,659,817 | A * | 11/1953 | Cutler | H01P 1/28 333/34 |
| 2,742,612 | A | 4/1956 | Cohn | |
| 2,956,143 | A | 10/1960 | Schall | |
| 2,958,754 | A | 11/1960 | Hahn | |
| 2,981,904 | A | 4/1961 | Ajioka et al. | |
| 3,260,832 | A | 7/1966 | Johnson | |
| 3,265,995 | A | 8/1966 | Hamasaki | |
| 3,430,023 | A | 2/1969 | Tingley | |
| 3,440,385 | A | 4/1969 | Smith | |
| 3,489,135 | A | 1/1970 | Astrella | |
| 3,536,129 | A | 10/1970 | White | |
| 3,639,717 | A | 2/1972 | Mochizuki | |
| 3,731,035 | A | 5/1973 | Jarvis et al. | |
| 3,737,812 | A | 6/1973 | Gaudio et al. | |

(Continued)

FOREIGN PATENT DOCUMENTS

| | | |
|---|---|---|
| CN | 1523293 A | 8/2004 |
| CN | 101118425 | 2/2008 |

(Continued)

*Primary Examiner* — Phuong T Nguyen

(74) *Attorney, Agent, or Firm* — Price Heneveld LLP

(57) ABSTRACT

A transition device for a hollow waveguide comprises a rectangular structure comprising an inlet wall and interior extending from the inlet wall along a longitudinal axis. The inlet wall is configured to receive a transmission line comprising an antenna. The antenna forms a proximal end proximate to the inlet wall and a distal end configured to extend into the rectangular structure of the hollow waveguide. A channel is formed in the rectangular structure. The channel comprises a base forming a tuning surface. The tuning surface is configured to extend along a length of the antenna in a spaced configuration parallel to the longitudinal axis.

20 Claims, 5 Drawing Sheets

(56) References Cited

U.S. PATENT DOCUMENTS 3,812,316 A 5/1974 Milburn
4,000,390 A 12/1976 Graff
4,019,009 A * 4/1977 Kusunoki ..... H05B 6/72 219/746
4,088,861 A 5/1978 Zwillinger
D248,607 S 7/1978 Yamamura et al.
4,101,750 A 7/1978 Doner
4,107,502 A 8/1978 Tanaka et al.
4,136,271 A 1/1979 Tanaka et al.
4,139,828 A 2/1979 Commault et al.
4,143,646 A 3/1979 Sampsel et al.
4,166,207 A 8/1979 Burke
4,196,332 A 1/1980 MacKay et al.
4,264,800 A 4/1981 Jahnke et al.
4,283,614 A 8/1981 Tanaka et al.
4,321,445 A 3/1982 Kristof et al.
4,335,289 A * 6/1982 Smith ..... H05B 6/642 219/749
4,354,562 A 10/1982 Newman
4,374,319 A 2/1983 Guibert
D268,079 S 3/1983 Miyake et al.
4,463,324 A 7/1984 Rolfs
D275,546 S 9/1984 Tanaka et al.
D276,122 S 10/1984 Tanaka et al.
D277,355 S 1/1985 Miyake et al.
4,595,827 A 6/1986 Hirai et al.
D285,893 S 9/1986 Mizuma et al.
4,628,351 A 12/1986 Heo
4,642,435 A * 2/1987 Fitzmayer ..... H05B 6/72 219/749
4,673,800 A 6/1987 Hirai et al.
4,703,151 A 10/1987 Sakamoto
4,743,728 A 5/1988 Nagafusa et al.
D297,698 S 9/1988 Nishikawa et al.
D297,800 S 9/1988 Feil et al.
4,783,639 A * 11/1988 Hudspeth ..... H01P 1/2138 333/126
4,786,774 A 11/1988 Kaminaka
D303,063 S 8/1989 Satake
4,870,238 A 9/1989 Hodgetts et al.
4,886,046 A 12/1989 Welch et al.
4,937,413 A 6/1990 Spruytenburg et al.
4,999,459 A 3/1991 Smith et al.
5,075,525 A 12/1991 Jung
D330,144 S 10/1992 Takebata et al.
5,369,254 A 11/1994 Kwon
D353,511 S 12/1994 Saimen
5,414,394 A * 5/1995 Gamand ..... H01P 5/107 333/26
5,483,045 A 1/1996 Gerling
5,488,380 A * 1/1996 Harvey ..... H01Q 21/0025 333/248
5,546,927 A 8/1996 Lancelot
5,558,800 A 9/1996 Page
5,576,670 A * 11/1996 Suzuki ..... H01P 1/2138 333/126
D378,723 S 4/1997 Weiss
5,619,983 A 4/1997 Smith
D385,155 S 10/1997 Weiss et al.
5,735,261 A 4/1998 Kieslinger
5,831,253 A 11/1998 Han et al.
5,850,074 A * 12/1998 Chung ..... H01J 25/04 219/761
5,878,910 A 3/1999 Gibernau et al.
D411,074 S 6/1999 Sakai et al.
5,912,598 A * 6/1999 Stones ..... H01P 5/107 333/26
5,919,389 A 7/1999 Uehashi et al.
5,928,540 A 7/1999 Antoine et al.
5,929,728 A * 7/1999 Barnett ..... H01P 3/121 29/600
5,935,479 A * 8/1999 Lee ..... H05B 6/707 219/746
5,973,305 A 10/1999 Kim et al.
5,981,929 A 11/1999 Maeda et al.
6,008,483 A * 12/1999 McKee ..... H05B 6/76 219/746
6,018,158 A 1/2000 Kang
6,054,696 A 4/2000 Lewis et al.
6,057,535 A 5/2000 Derobert et al.
6,097,019 A 8/2000 Lewis et al.
6,265,950 B1 * 7/2001 Schmidt ..... H01P 5/107 333/26
6,268,593 B1 7/2001 Sakai
6,359,270 B1 3/2002 Bridson
6,429,370 B1 8/2002 Norte et al.
6,557,756 B1 5/2003 Smith
6,559,882 B1 5/2003 Kerchner
D481,582 S 11/2003 Seum et al.
6,664,523 B1 12/2003 Kim et al.
6,696,678 B2 2/2004 Hudson et al.
D495,556 S 9/2004 Milrud et al.
6,794,950 B2 * 9/2004 du Toit ..... H01P 5/107 333/21 R
6,822,528 B2 * 11/2004 Dawn ..... H01P 5/107 333/26
6,853,399 B1 2/2005 Gilman et al.
D521,799 S 5/2006 Ledingham et al.
D522,801 S 6/2006 Lee
7,068,121 B2 * 6/2006 Ding ..... H01P 5/08 333/21 R
D527,572 S 9/2006 Lee et al.
7,105,787 B2 9/2006 Clemen, Jr.
7,111,247 B2 9/2006 Choi et al.
D530,973 S 10/2006 Lee et al.
D531,447 S 11/2006 Lee et al.
D532,645 S 11/2006 Lee
7,193,195 B2 3/2007 Lundstrom et al.
D540,105 S 4/2007 Lee et al.
D540,613 S 4/2007 Jeon
D550,024 S 9/2007 Jeon
7,361,871 B2 4/2008 Cho et al.
D568,675 S 5/2008 Kawata
7,476,828 B2 1/2009 Genua
7,482,562 B2 1/2009 Song et al.
D586,619 S 2/2009 Pino et al.
D587,959 S 3/2009 Hensel
7,556,033 B2 7/2009 Kim
D602,306 S 10/2009 Lavy
7,603,097 B2 * 10/2009 Leblanc ..... G01S 7/032 342/70
7,770,985 B2 8/2010 Davis et al.
D625,557 S 10/2010 Pino et al.
D626,370 S 11/2010 Baek
7,881,689 B2 * 2/2011 Leblanc ..... H05K 9/0007 455/300
7,919,735 B2 4/2011 Kiyono et al.
7,926,313 B2 4/2011 Schenkl et al.
D638,249 S 5/2011 Ryan et al.
8,074,637 B2 12/2011 Yamauchi
D655,970 S 3/2012 De'Longhi
D658,439 S 5/2012 Curtis et al.
D662,759 S 7/2012 Blacken et al.
D663,156 S 7/2012 Curtis et al.
8,244,287 B2 * 8/2012 Tavassoli Hozouri ..... H01P 5/181 455/500
D670,529 S 11/2012 Hensel
D673,000 S 12/2012 De'Longhi
D673,418 S 1/2013 Lee et al.
D678,711 S 3/2013 Reiner
8,389,916 B2 3/2013 Ben-Shmuel et al.
8,390,403 B1 * 3/2013 Schaffner ..... H01Q 13/02 333/250
8,455,803 B2 6/2013 Danzer et al.
8,492,686 B2 7/2013 Bilchinsky et al.
8,530,807 B2 9/2013 Niklasson et al.
8,552,813 B2 * 10/2013 Gritters ..... H01P 5/107 333/26
8,610,038 B2 12/2013 Hyde et al.
8,745,203 B2 6/2014 McCoy
8,803,051 B2 8/2014 Lee et al.

(56) References Cited

U.S. PATENT DOCUMENTS

| | | | | |
|---|---|---|---|---|
| 8,860,532 | B2 * | 10/2014 | Gong | H01P 1/208 333/202 |
| D717,579 | S | 11/2014 | Gregory et al. | |
| 9,040,879 | B2 | 5/2015 | Libman et al. | |
| D736,554 | S | 8/2015 | Steiner et al. | |
| D737,620 | S | 9/2015 | Miller et al. | |
| D737,622 | S | 9/2015 | Miller et al. | |
| 9,131,543 | B2 | 9/2015 | Ben-Shmuel et al. | |
| 9,132,408 | B2 | 9/2015 | Einziger et al. | |
| 9,179,506 | B2 | 11/2015 | Sim et al. | |
| 9,210,740 | B2 | 12/2015 | Libman et al. | |
| 9,215,756 | B2 | 12/2015 | Bilchinsky et al. | |
| 9,351,347 | B2 | 5/2016 | Torres et al. | |
| 9,374,852 | B2 | 6/2016 | Bilchinsky et al. | |
| D769,669 | S | 10/2016 | Kim et al. | |
| 9,538,585 | B2 * | 1/2017 | Nordh | H05B 6/6494 |
| 9,560,699 | B2 | 1/2017 | Zhylkov et al. | |
| 9,585,203 | B2 | 2/2017 | Sadahira et al. | |
| 10,381,317 | B2 * | 8/2019 | Maaskant | H01L 23/66 |
| 10,444,340 | B2 * | 10/2019 | Nagaishi | G01S 13/58 |
| 10,483,611 | B2 * | 11/2019 | Sugano | H01Q 21/0006 |
| 10,490,874 | B2 * | 11/2019 | Smith, Jr. | H01P 5/024 |
| 2001/0000403 | A1 * | 4/2001 | Gaisford | G01N 30/30 219/748 |
| 2005/0162335 | A1 | 7/2005 | Ishii | |
| 2006/0289526 | A1 | 12/2006 | Takizaki et al. | |
| 2009/0134155 | A1 | 5/2009 | Kim et al. | |
| 2009/0295494 | A1 | 12/2009 | Carter et al. | |
| 2010/0176121 | A1 | 7/2010 | Nobue et al. | |
| 2010/0187224 | A1 | 7/2010 | Hyde et al. | |
| 2011/0031236 | A1 | 2/2011 | Ben-Shmuel et al. | |
| 2011/0168699 | A1 | 7/2011 | Oomori et al. | |
| 2011/0290790 | A1 | 12/2011 | Sim et al. | |
| 2012/0067872 | A1 | 3/2012 | Libman et al. | |
| 2012/0103972 | A1 | 5/2012 | Okajima | |
| 2012/0152939 | A1 | 6/2012 | Nobue et al. | |
| 2012/0160830 | A1 | 6/2012 | Bronstering | |
| 2013/0048881 | A1 | 2/2013 | Einziger et al. | |
| 2013/0080098 | A1 | 3/2013 | Hadad et al. | |
| 2013/0142923 | A1 | 6/2013 | Torres et al. | |
| 2013/0156906 | A1 | 6/2013 | Raghavan et al. | |
| 2013/0186887 | A1 | 7/2013 | Hallgren et al. | |
| 2013/0200066 | A1 | 8/2013 | Gelbart et al. | |
| 2013/0277353 | A1 | 10/2013 | Joseph et al. | |
| 2014/0197161 | A1 | 7/2014 | Dobie | |
| 2014/0203012 | A1 | 7/2014 | Corona et al. | |
| 2014/0208957 | A1 | 7/2014 | Imai et al. | |
| 2014/0277100 | A1 | 9/2014 | Kang | |
| 2014/0285393 | A1 * | 9/2014 | Biglarbegian | H01P 11/001 343/850 |
| 2015/0034632 | A1 | 2/2015 | Brill et al. | |
| 2015/0070029 | A1 | 3/2015 | Libman et al. | |
| 2015/0136758 | A1 | 5/2015 | Yoshino et al. | |
| 2015/0156827 | A1 | 6/2015 | Ibragimov et al. | |
| 2015/0173128 | A1 | 6/2015 | Hosokawa et al. | |
| 2015/0271877 | A1 | 9/2015 | Johansson | |
| 2015/0289324 | A1 | 10/2015 | Rober et al. | |
| 2015/0305095 | A1 | 10/2015 | Huang et al. | |
| 2015/0334788 | A1 | 11/2015 | Hofmann et al. | |
| 2015/0373789 | A1 | 12/2015 | Meusburger et al. | |
| 2016/0029442 | A1 | 1/2016 | Houbloss et al. | |
| 2016/0088690 | A1 | 3/2016 | Kubo et al. | |
| 2016/0119982 | A1 | 4/2016 | Kang et al. | |
| 2016/0219656 | A1 | 7/2016 | Hunter, Jr. | |
| 2016/0327281 | A1 | 11/2016 | Bhogal et al. | |
| 2016/0353528 | A1 | 12/2016 | Bilchinsky et al. | |
| 2016/0353529 | A1 | 12/2016 | Omori et al. | |
| 2017/0099988 | A1 | 4/2017 | Matloubian et al. | |
| 2017/0105572 | A1 | 4/2017 | Matloubian et al. | |
| 2018/0358677 | A1 * | 12/2018 | Artemenko | H01Q 1/50 |
| 2021/0136884 | A1 * | 5/2021 | Park | H05B 6/72 |

FOREIGN PATENT DOCUMENTS

| | | | |
|---|---|---|---|
| CN | 201081287 | Y | 7/2008 |
| CN | 102012051 | A | 4/2011 |
| CN | 102620324 | A | 8/2012 |
| CN | 103156532 | A | 6/2013 |
| CN | 203025135 | U | 6/2013 |
| CN | 105042654 | A | 11/2015 |
| CN | 204987134 | U | 1/2016 |
| CN | 106103555 | A | 11/2016 |
| DE | 3238441 | A1 | 4/1984 |
| DE | 102004002466 | A1 | 8/2005 |
| DE | 102008042467 | A1 | 4/2010 |
| EP | 0199264 | A2 | 10/1986 |
| EP | 0493623 | A1 | 8/1992 |
| EP | 1193584 | | 3/2002 |
| EP | 1424874 | A2 | 6/2004 |
| EP | 1426692 | A2 | 6/2004 |
| EP | 1471773 | A2 | 10/2004 |
| EP | 1732359 | A2 | 12/2006 |
| EP | 1795814 | | 6/2007 |
| EP | 1970631 | A2 | 9/2008 |
| EP | 2031938 | A1 | 3/2009 |
| EP | 2205043 | A1 | 7/2010 |
| EP | 2230463 | A1 | 9/2010 |
| EP | 2220913 | B1 | 5/2011 |
| EP | 2512206 | A1 | 10/2012 |
| EP | 2405711 | A2 | 11/2012 |
| EP | 2618634 | A1 | 7/2013 |
| EP | 2775794 | A1 | 9/2014 |
| EP | 2906021 | A1 | 8/2015 |
| EP | 2393339 | B1 | 12/2016 |
| FR | 2766272 | A1 | 1/1999 |
| FR | 2976651 | A | 12/2012 |
| GB | 639470 | A | 6/1950 |
| GB | 1424888 | | 2/1976 |
| GB | 2158225 | A | 11/1985 |
| GB | 2193619 | A | 2/1988 |
| GB | 2338607 | A | 12/1999 |
| GB | 2367196 | A | 3/2002 |
| JP | S55155120 | A | 12/1980 |
| JP | 57194296 | U | 12/1982 |
| JP | 59226497 | A | 12/1984 |
| JP | H0510527 | A | 1/1993 |
| JP | H06147492 | A | 5/1994 |
| JP | 8-171986 | | 7/1996 |
| JP | 2000304593 | A | 11/2000 |
| JP | 2008108491 | A | 5/2008 |
| JP | 2011146143 | A | 7/2011 |
| JP | 2013073710 | A | 4/2013 |
| KR | 2050002121 | | 7/2005 |
| KR | 101359460 | B1 | 2/2014 |
| KR | 20160093858 | A | 8/2016 |
| RU | 2122338 | C1 | 11/1998 |
| RU | 2215380 | C2 | 10/2003 |
| RU | 2003111214 | A | 11/2004 |
| RU | 2003122979 | A | 2/2005 |
| RU | 2008115817 | A | 10/2009 |
| RU | 2008137844 | A | 3/2010 |
| WO | 8807805 | A1 | 10/1988 |
| WO | 0036880 | | 6/2000 |
| WO | 02065036 | A1 | 8/2002 |
| WO | 03077601 | A1 | 9/2003 |
| WO | 2008018466 | A1 | 2/2008 |
| WO | 2008102360 | A2 | 8/2008 |
| WO | 2009039521 | A1 | 3/2009 |
| WO | 2011138680 | A2 | 11/2011 |
| WO | 2012001523 | A2 | 1/2012 |
| WO | 2012162072 | | 11/2012 |
| WO | 2011039961 | A1 | 2/2013 |
| WO | 2015024177 | A1 | 2/2015 |
| WO | 2015099648 | A1 | 7/2015 |
| WO | 2015099650 | A1 | 7/2015 |
| WO | 2015099651 | A1 | 7/2015 |
| WO | 2016128088 | A1 | 8/2016 |
| WO | 2017190792 | A1 | 11/2017 |

* cited by examiner

IN LINE E-PROBE WAVEGUIDE TRANSITION

TECHNOLOGICAL FIELD

The present device generally relates to a waveguide for electromagnetic field propagation, and, more specifically, to a longitudinal transition for a waveguide.

BACKGROUND

Microwave transmitters are commonly connected to cavities of microwave ovens via transmission lines. Such transmission lines may be coupled to cooking cavities of microwaves via waveguides. The disclosure provides for a novel transition for a longitudinal waveguide as described in the following detailed description.

SUMMARY

In at least one aspect, a transition device for a hollow waveguide is disclosed. The device comprises a rectangular structure comprising an inlet wall and interior extending from the inlet wall along a longitudinal axis. The inlet wall is configured to receive a transmission line comprising an antenna. The antenna forms a proximal end proximate to the inlet wall and a distal end configured to extend into the rectangular structure of the hollow waveguide. A channel is formed in the rectangular structure. The channel comprises a base forming a tuning surface. The tuning surface is configured to extend along a length of the antenna in a spaced configuration parallel to the longitudinal axis.

In at least another aspect, a method for generating an electrical field in a hollow waveguide is disclosed. The method comprises transmitting electrical current at a frequency into an inlet wall of the hollow waveguide via a transmission line. The method further comprises emitting electromagnetic energy radially from an antenna at the frequency perpendicular to a longitudinal axis of the hollow waveguide. The method further comprises tuning the electromagnetic energy via an excitation surface of a channel that at least partially bisects the hollow waveguide. The method additionally comprises controlling the electromagnetic energy via the channel in a cavity extending between the inlet wall and the channel. The electromagnetic energy is controlled to propagate parallel to the longitudinal axis of the hollow waveguide. In at least another aspect, a transition device for a hollow waveguide is disclosed. The transition device comprises an elongated rectangular structure comprising an inlet wall and an interior volume extending from the inlet wall along a longitudinal axis. The inlet wall is configured to receive a transmission line comprising an antenna forming a proximal end proximate to the inlet wall and a distal end configured to extend into the rectangular structure. A capacitive channel is formed through a width of the rectangular structure substantially perpendicular to the longitudinal axis. The capacitive channel comprises a base portion forming a tuning surface. The tuning surface is configured to extend along a length of the antenna in a space configuration parallel to the longitudinal axis of the elongated rectangular structure.

These and other features, advantages, and objects of the present device will be further understood and appreciated by those skilled in the art upon studying the following specification, claims, and appended drawings.

DETAILED DESCRIPTION OF EMBODIMENTS

Figure 1:
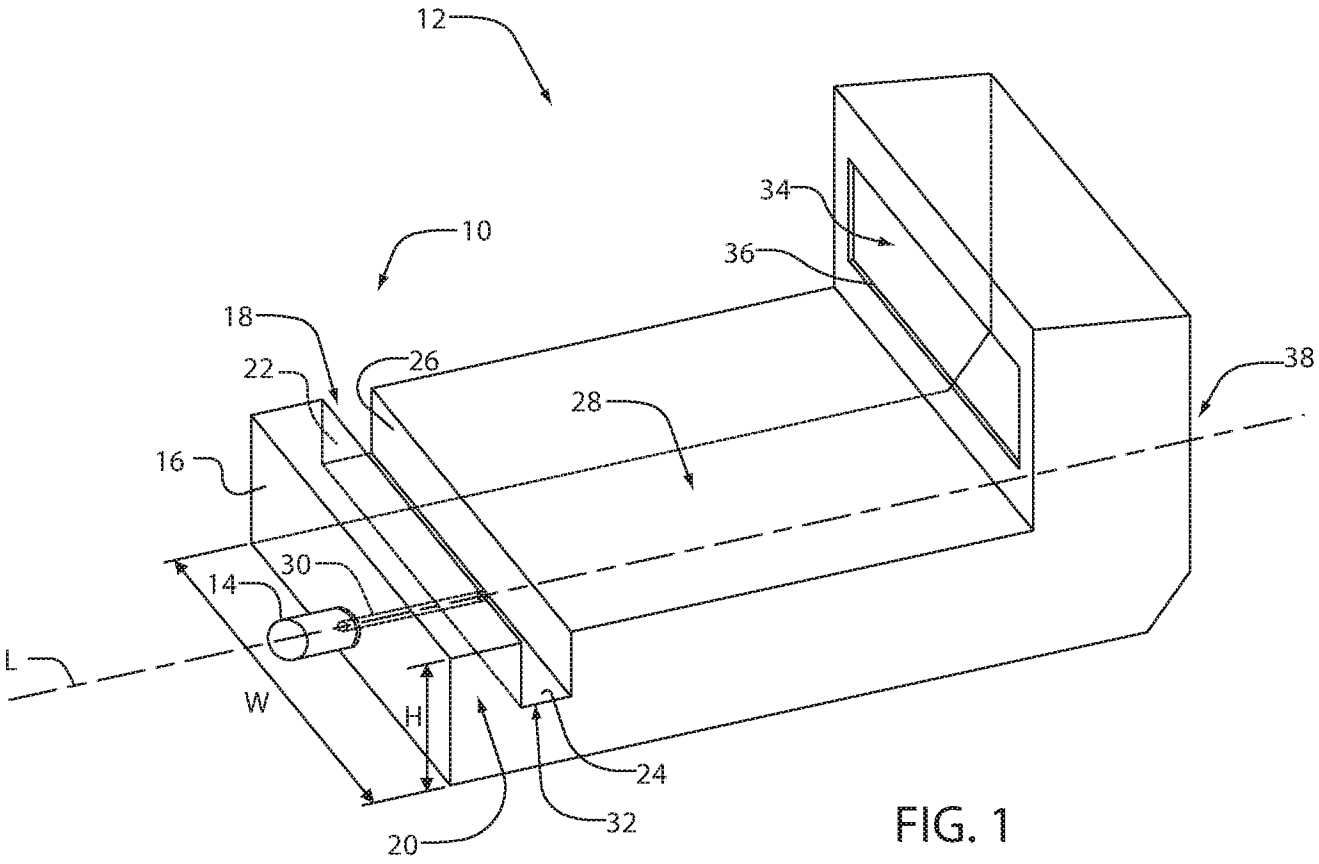
FIG. 1 is a projected schematic view of a longitudinal transition device for a hollow waveguide.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, a projected view of a longitudinal transition device 10 for a hollow waveguide 12 is shown. The transition device 10 may be configured to receive a transmission line 14 via an inlet wall 16. The waveguide 12 may generally form an elongated rectangular form having a Height and a Width extending along a longitudinal axis L. In this configuration, the longitudinal transition device 10 may provide for an inline transition for the transmission line 14 configured to generate transverse electric propagation of electromagnetic radiation transmitted through the waveguide 12 along the longitudinal axis L.

In an exemplary embodiment, a rectangular channel 18 may be formed through the width W of the hollow waveguide 12. In this configuration, the rectangular channel 18 may form a cavity 20 extending from the inlet wall 16 to a first wall 22 of the rectangular channel 18. A base portion 24 may extend from the first wall 22 of the rectangular channel 18 to a second wall 26 of the rectangular channel 18. In this configuration, the rectangular channel 18 may at least partially bisect an interior volume 28 of the hollow waveguide 12 providing for the cavity 20 to be formed proximate to the inlet wall 16. Accordingly, the first wall 22 and the opening formed by the channel 18 may define a length of the cavity 20.

The transition device 10 of the waveguide 12 may be configured to receive a probe 30 or antenna extending through the inlet wall 16 from the transmission line 14. The probe 30 may extend along the longitudinal axis L of the waveguide 12 from a proximal end portion 30*a* at the inlet wall 16 to a distal end portion 30*b*. The distal end portion 30*b* may terminate proximate to the second wall 26 of the rectangular channel 18. In this configuration, the probe 30 may extend parallel to a tuning surface 32 within the interior volume 28 formed by the base portion 24 of the rectangular channel 18. In this configuration, the rectangular channel 18 may form a cutout portion extending transverse to the longitudinal axis L of the waveguide 12 and provide a capacitive tuning channel (e.g. the rectangular channel 18) via the tuning surface 32.

In some embodiments, the transmission line 14 may correspond to a coaxial transmission line or other forms of conductive connectors. The probe 30 may correspond to a core portion of the transmission line 14, and, in some embodiments, may be implemented to an antenna or a microstrip antenna. The operation of the transition device 10 may be derived based on the duality theorem of quantum mechanics such that the transition device 10 is optimized to propagate electromagnetic radiation through the hollow waveguide 12 at a desired frequency. In some embodiments, the desired frequency may be between approximately 2.4 and 2.5 GHz. As further discussed in reference to FIGS. 4 and 5, the performance of the transition device 10 may be optimized to transmit power from the inlet wall 16 to an outlet 34 depicted in FIG. 1 as a rectangular aperture formed in an exterior wall 36 of the waveguide 12.

In some embodiments, the waveguide 12 may comprise rectangular transition portion 38 formed perpendicular to the waveguide 12. The transition section 38 may perpendicularly or angularly align with a passage formed by the interior volume 28 of the waveguide 12. In this configuration, the transition section 38 may be configured to transmit the electromagnetic radiation upward from a linear portion of the waveguide 12 extending along the longitudinal axis to the outlet 34 formed in the exterior wall 36. In this way, the waveguide 12 may be configured to transmit the electromagnetic radiation through the interior volume 28 outward through the outlet 34.

Figure 2:
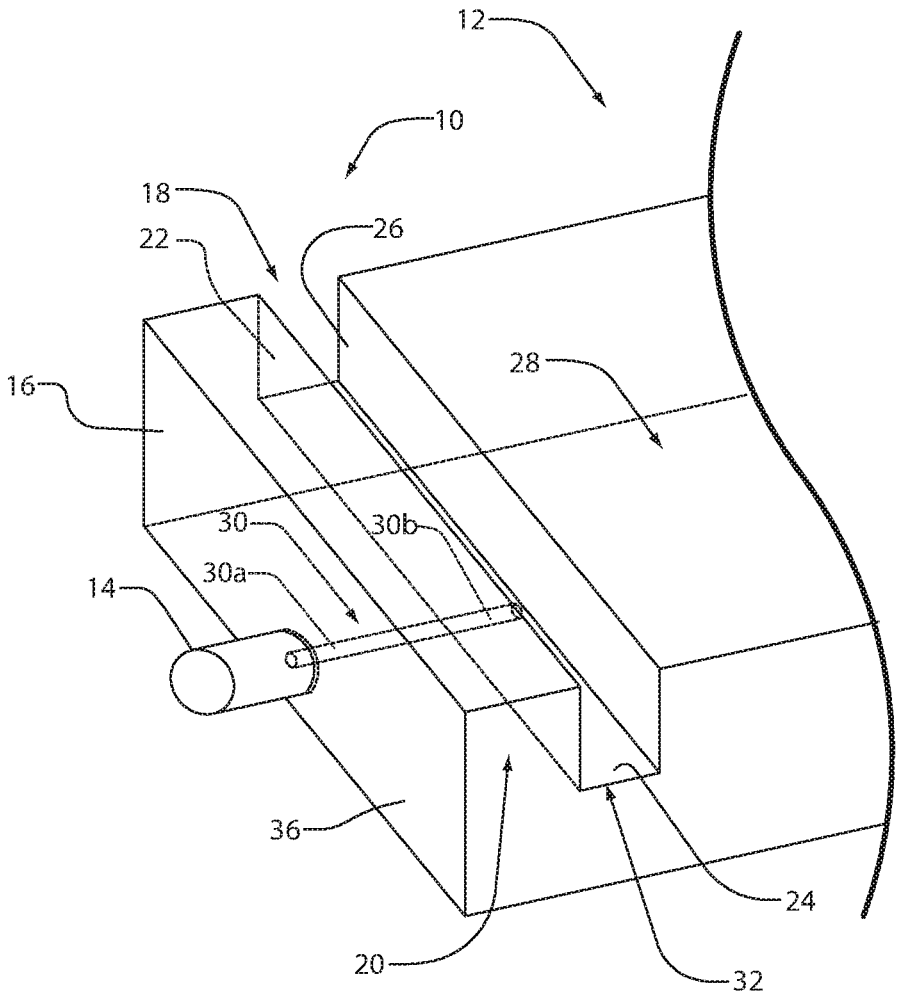
FIG. 2 is a detailed projected schematic view of the longitudinal transition device depicted in the FIG. 1.

FIG. 2 demonstrates a detailed projected view of the transition device 10 of the waveguide 12 in accordance with the disclosure. Referring now to FIGS. 1 and 2, the distal end portion 30*b* of the probe 30 is shown extending from the proximal end portion 30*a* parallel to the tuning surface 32 formed by the base portion 24 of the rectangular channel 18. The distal end portion 30*b* may terminate proximate to the second wall 26 of the rectangular channel 18. In this configuration, electromagnetic radiation may be emitted radially outward from the probe 30 and substantially into the tuning surface 32 of the rectangular channel 18. Based on the configuration of the rectangular channel 18 and the cavity 20, the electromagnetic radiation emitted from the probe 30 may be controlled by the transition device 10 to propagate perpendicular to the longitudinal axis L of the waveguide 12 outward toward the outlet 34. In this configuration, the transition device 10 may provide for the electromagnetic radiation emitted from the probe 30 to be transmitted through the hollow waveguide 12 at a high level of efficiency. The propagation of the waves through the waveguide 12 is further discussed in reference to FIGS. 4 and 5.

Figure 3:
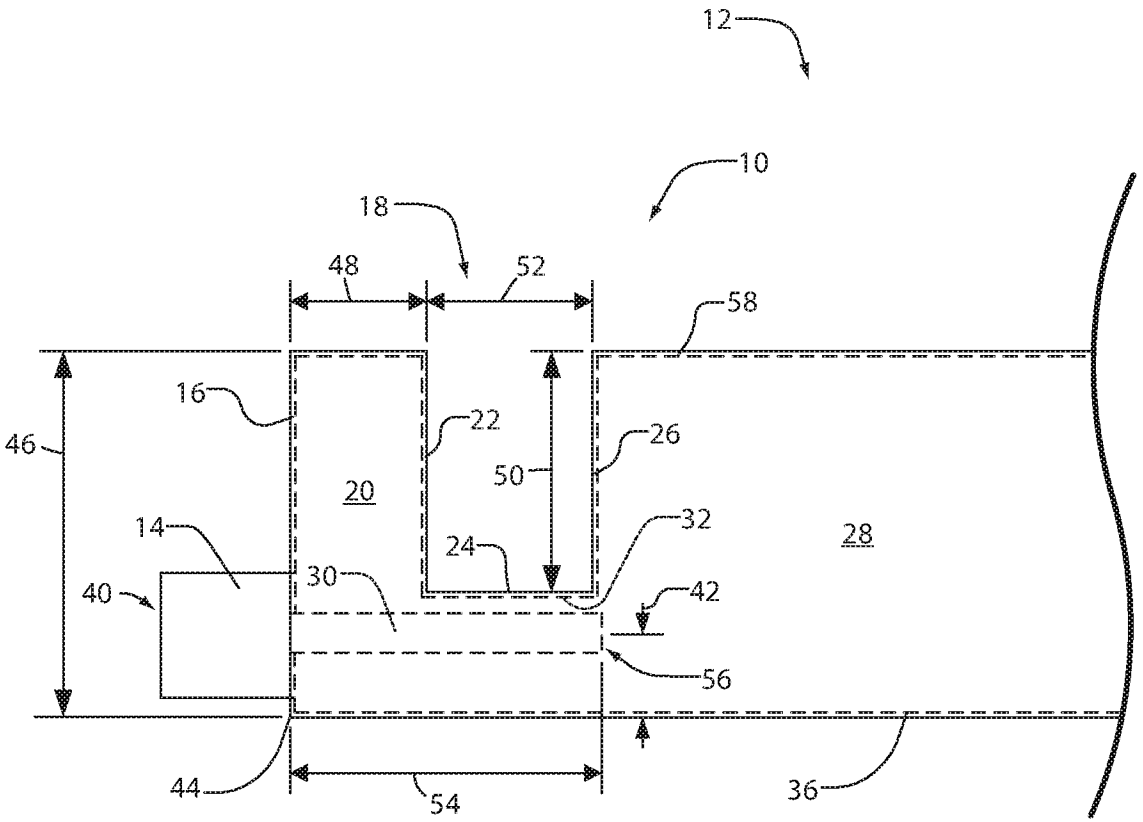
FIG. 3 is a side schematic view of a transition portion of the hollow waveguide depicted in FIG. 1.

Referring now to FIG. 3, a detailed side cross-sectional view of the transition device 10 is shown. As discussed herein, the proportions of the rectangular channel 18 and the cavity 20 may provide for the efficient control and transmission of wavelengths through the waveguide 12 at a target frequency or frequency range. As demonstrated in FIG. 3, the specific proportions of an exemplary embodiment of the transition device 10 are demonstrated. Though the specific dimensional values for the proportions of the transition device 10 are discussed in reference to FIG. 3, the dimensions of the device may vary based on a desired frequency transmission range, proportions of the waveguide device, or various additional factors that may be understood to those having skill in the art. Accordingly, the invention as discussed herein may not be limited by the specific dimensional specifications provided here, which are provided to clearly describe at least one exemplary embodiment.

As demonstrated in FIG. 3, the transition device 10 may be configured having specific dimensional proportions. For example, the transmission line 14 may comprise a transmission line diameter 40 configured to engage the inlet wall 16 at an engagement height 42. Additionally, the cavity 20 may extend a cavity height 46 from a lower surface 44 of the transition device 10. In this configuration, the cavity 20 may extend above the transmission line 14 and the probe 30 creating a volumetric opening in contiguous connection with the interior volume 28 formed by the rectangular structure of the hollow waveguide 12. The cavity 20 may further extend forward from the inlet wall 16 to the first wall 22 along a cavity length 48. Accordingly, the cavity 20 may be formed above the probe 30 extending along the longitudinal axis L of the hollow waveguide 12 from the inlet wall 16 to the first wall 22 of the rectangular channel 18.

The rectangular channel 18 may comprise a channel height 50 formed by the first wall 22 and the second wall 26. The base portion 24 may separate the first wall 22 from the second wall 26 by a base length 52. In this configuration, a tuning surface 32 formed by the base portion 24 of the rectangular channel 18 may extend in a spaced configuration parallel to the probe 30. Additionally, as previously discussed herein, the probe 30 may comprise the distal end portion 30*b* extending from the proximal end portion 30*a* along a probe length 54. In this configuration, a probe diameter 56 or thickness of the probe 30 may terminate at the distal end portion 30*b* proximate to the second wall 26 of the rectangular channel 18.

Exemplary measurements for the dimensional characteristics of the longitudinal transition device 10 are provided in Table 1 to demonstrate the relative proportions of the characteristics that may provide the performance characteristics as discussed herein. Again, the dimensional values provided herein shall not be considered limiting to the scope of the disclosure. In general, the base length 52 of the rectangular channel 18 may be greater than the cavity length 48 of the cavity 20. Additionally, the channel height 50 may extend from an upper surface 58 to the base portion 24 such that the probe 30 is at least partially separated from the tuning surface 32 in a spaced configuration. Finally, the probe length 54 may be configured to extend such that the distal end portion 30*b* extends along the longitudinal axis L of the waveguide 12 from the inlet wall 16 to beyond the second wall 26 of the rectangular channel 18. As provided by the disclosure, additional characteristics of the longitudinal transition device 10 may be interpreted from the exemplary dimensions provided in Table 1.

TABLE 1

Exemplary dimensions for longitudinal transition device

| Element No. | Element Description | Dimension (mm) |
|---|---|---|
| 40 | transmission line diameter | 9.0 |
| 42 | engagement height | 5.8 |
| 46 | cavity height | 28.0 |
| 48 | cavity length | 11.0 |
| 50 | channel height | 19.0 |
| 52 | base length | 12.0 |
| 54 | probe length | 24.5 |
| 56 | probe diameter | 3.0 |

Figure 4:
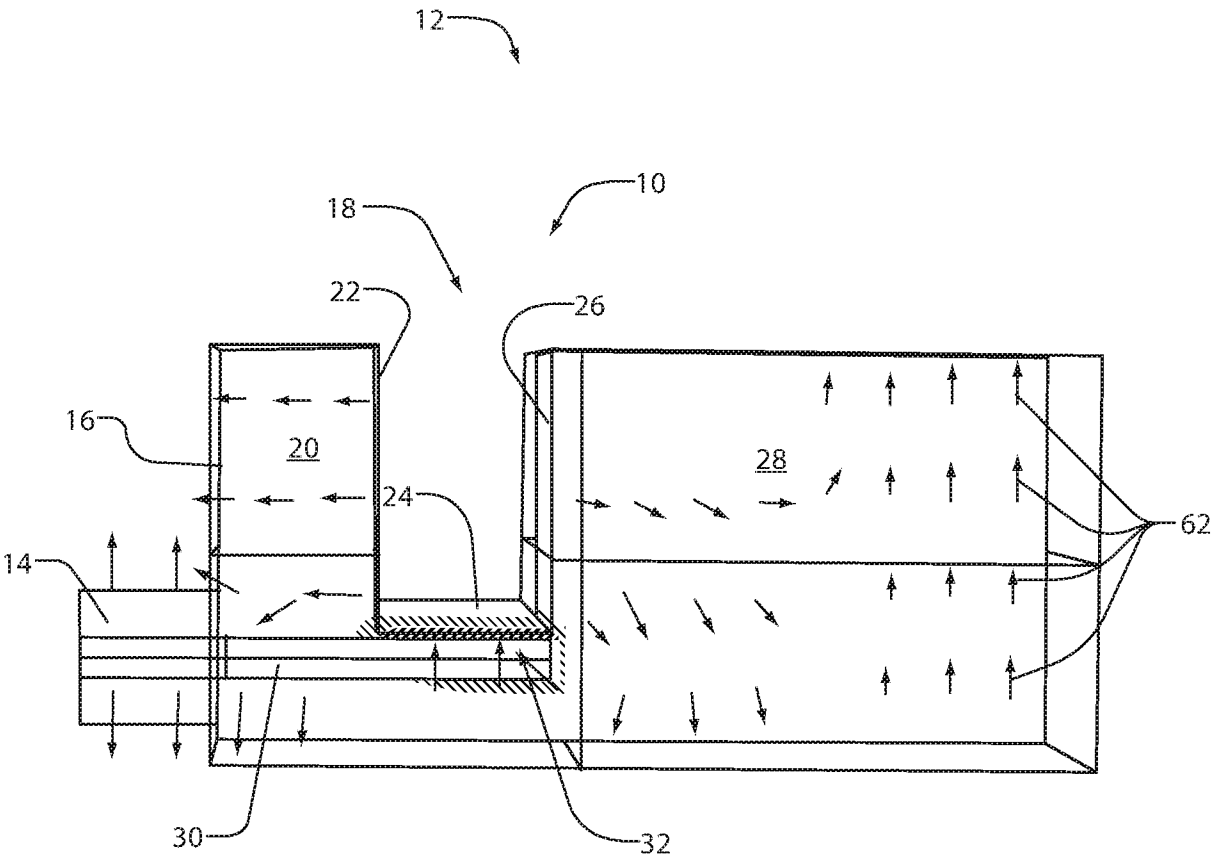
FIG. 4 is a projected view of a transition device for a hollow waveguide demonstrating the electromagnetic field lines simulated at a target input frequency.
Figure 5:
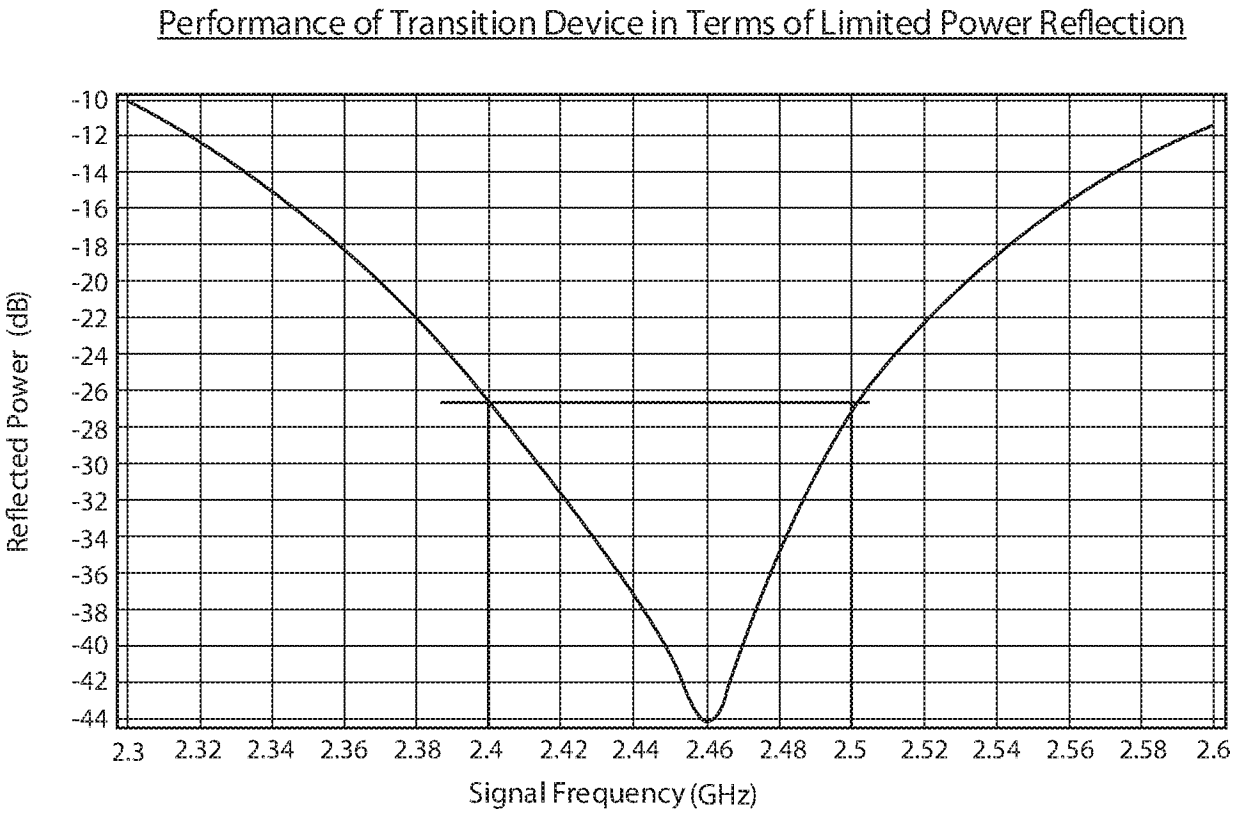
FIG. 5 is a plot of the simulated power reflected by the waveguide back to an inlet in accordance with the disclosure.

Referring now to FIGS. 4 and 5, simulation results for the performance of the transition device 10 of the hollow waveguide 12 are now discussed in further detail. Referring first to FIG. 4, the transition device 10 is shown having an input signal with a target frequency simulated as an input to the transmission line 14. As shown, the target frequency of the input signal applied to the transmission line 14 may be approximately 2.4 GHz to 2.5 GHz. A plurality of magnetic field lines 62 are demonstrated as directional arrows indicating the direction of the electromagnetic field induced within the transition device 10 of the hollow waveguide 12. As shown, the magnetic field lines 62 radiate outward from the probe 30 into the interior volume 28 formed by the transition device 10. In the cavity 20, the magnetic field lines 62 flow approximately from the first wall 22 to the inlet wall 16. Additionally, the magnetic field lines 62 flow outward from the second wall 26 toward the outlet 34 of the waveguide 12. Based on the configuration of the rectangular channel 18 and the cavity 20, the magnetic field lines 62 in a body portion of the waveguide 12 propagate perpendicular to the longitudinal axis L of the hollow waveguide 12. In this way, the longitudinal transition device 10 discussed herein provides for the control of the electromagnetic field within the hollow waveguide 12 such that the magnetic field lines 62 are propagated perpendicular to the longitudinal axis L as the electromagnetic energy is transmitted through the hollow waveguide 12.

Referring now to FIG. 5, a plot of the power reflected back within the waveguide 12 to the inlet wall 16 is shown. The amount of power or electromagnetic energy reflected back to the inlet wall 16 is demonstrated at the target wavelengths ranging from 2.4 GHz to 2.5 GHz. For clarity, the amount of power reflected back to the inlet wall 16 may be an indication of negative performance characteristics that may limit the transmission of the electromagnetic energy from the waveguide 12 into a microwave heating cavity. As demonstrated in FIG. 5, at an exemplary target frequency of 2.46 GHz, the energy reflected back by the waveguide 12 to the inlet wall 16 is less than one percent (1%) of the total power delivered into the waveguide 12. Accordingly, the vast majority of the energy transmitted into the waveguide 12 through the transmission line 14 is transmitted outward from the waveguide 12 into the microwave cavity via the outlet 34. In this way, the longitudinal transition device 10 of the hollow waveguide 12 may provide for efficient operation and transmission of the electromagnetic energy into a microwave cavity.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A hollow waveguide configured to transmit energy to a cooking cavity of a microwave device comprising a transition device, the transition device comprising:

a rectangular structure comprising an inlet wall, an interior volume formed within the rectangular structure extending from the inlet wall along a first longitudinal axis, and an outlet formed through an exterior wall of the transition device configured to transmit the electromagnetic radiation from the interior volume, through the outlet, and into the cooking cavity, wherein the inlet wall receives a transmission line comprising an antenna that extends through the inlet wall and into an interior volume within the transition device, wherein the antenna forms a proximal end proximate to the inlet wall and a distal end that extends into the interior volume of the rectangular structure; and a channel extending into the interior volume of the rectangular structure, the channel comprising a base portion forming a tuning surface, wherein the tuning surface extends along a length of the antenna within the interior volume in a spaced configuration parallel to the first longitudinal axis.

2. The hollow waveguide according to claim 1, wherein the first longitudinal axis extends parallel to a length of the transmission line.

3. The hollow waveguide according to claim 1, wherein the channel is arranged transverse to the first longitudinal axis of the rectangular structure and extends through a width of the hollow waveguide.

4. The hollow waveguide according to claim 1, wherein the channel comprises a first channel wall and a second channel wall, wherein the first channel wall and the second channel wall are separated by the base portion.

5. The hollow waveguide according to claim 4, wherein the hollow waveguide receives the antenna and the distal end terminates in the rectangular structure proximate to the second channel wall.

6. The hollow waveguide according to claim 1, wherein the channel forms a cavity extending from the inlet wall to a first channel wall.

7. The hollow waveguide according to claim 6, wherein the rectangular structure forms a contiguous interior volume that receives the antenna from the inlet wall.

8. The hollow waveguide according to claim 7, wherein the contiguous interior volume is bisected by the channel forming the cavity extending from the inlet wall.

9. The hollow waveguide according to claim 1, wherein the base portion extends from a first channel wall to a second channel wall of the channel, and wherein the first channel wall and the second channel wall are parallel to the inlet wall.

10. The hollow waveguide according to claim 1, wherein the channel is formed along a second longitudinal axis, wherein the second longitudinal axis is perpendicular to the first longitudinal axis.

11. The hollow waveguide according to claim 10, wherein the channel forms a rectangular opening through the rectangular structure of the hollow waveguide.

12. The hollow waveguide according to claim 1, wherein the channel comprises a cut out portion defined by a plurality of walls that includes the base portion, where in the cut out portion extends through the rectangular structure along the second longitudinal axis.

13. A hollow waveguide configured to transmit energy to a cooking cavity of a microwave device comprising a transition device, the transition device comprising:

an elongated rectangular structure comprising an inlet wall and an outlet passage formed through an exterior wall of the transition device, wherein the electromagnetic radiation is transmitted from the interior volume, through the outlet passage, and into the cooking cavity, the elongated rectangular structure forming an interior volume extending from the inlet wall along a longitudinal axis, wherein the inlet wall is configured to receive a transmission line comprising an antenna that extends through the inlet wall, wherein the antenna forms a proximal end proximate to the inlet wall and a distal end configured to extend into the interior volume of the elongated rectangular structure; and a capacitive channel formed through a width of the elongated rectangular structure perpendicular to the longitudinal axis, the capacitive channel comprising a base portion forming a tuning surface, wherein the tuning surface extends along a length of the antenna in a spaced configuration parallel to the longitudinal axis.

14. The hollow waveguide according to claim 13, further comprising:

a cavity formed by a first channel wall of the capacitive channel and the inlet wall.

15. The hollow waveguide according to claim 14, wherein the distal end of the antenna terminates proximate to a second channel wall of the capacitive channel.

16. The hollow waveguide according to claim 15, wherein the second channel wall of the capacitive channel is spaced apart from the first capacitive wall by the base portion.

17. The hollow waveguide according to claim 13, wherein the capacitive channel extends into the interior volume of the rectangular structure forming a cavity extending from the inlet wall.

18. The hollow waveguide according to claim 13, wherein the capacitive channel extends into the interior volume of the elongated rectangular structure.

19. A hollow waveguide transition device configured to transmit energy to a cooking cavity of a microwave device, the transition device comprising:

a rectangular structure comprising an inlet wall, an interior volume formed within the rectangular structure extending from the inlet wall along a longitudinal axis, and an outlet passage formed through an exterior wall of the transition device, wherein the inlet wall is configured to receive a transmission line comprising an antenna that extends through the inlet wall and into an interior volume within the transition device, and wherein the outlet passage is configured to transmit the electromagnetic radiation from the interior volume into the cooking cavity; and a channel extending into the interior volume of the rectangular structure, the channel comprising a base portion forming a tuning surface, wherein a length of the antenna extends parallel to an exterior wall of the rectangular structure at a first distance proximate to the inlet wall and extends parallel to the tuning surface of the channel at a second distance that is less than the first distance.

20. The hollow waveguide according to claim 19, wherein a difference between the first distance and the second distance corresponds to a depth of the base portion of the channel relative to the exterior wall.

* * * * *